US008678982B2

(12) United States Patent
Pellot

(10) Patent No.: US 8,678,982 B2
(45) Date of Patent: Mar. 25, 2014

(54) HEIGHT ADJUSTABLE DOUBLE END TRAINING BAG

(76) Inventor: Rene Pellot, New York, NY (US)

( * ) Notice: Subject to any disclaimer, the term of this patent is extended or adjusted under 35 U.S.C. 154(b) by 321 days.

(21) Appl. No.: 13/073,569

(22) Filed: Mar. 28, 2011

(65) Prior Publication Data

US 2012/0252637 A1 Oct. 4, 2012

(51) Int. Cl.
*A63B 21/00* (2006.01)

(52) U.S. Cl.
USPC ..... 482/83; 482/86; 482/89

(58) Field of Classification Search
USPC ..... 482/83, 89, 90, 84, 87
See application file for complete search history.

(56) References Cited

U.S. PATENT DOCUMENTS 426,944 A * 4/1890 Lovatt ..... 482/89
2003/0032532 A1* 2/2003 Broadwater ..... 482/121

* cited by examiner

*Primary Examiner* — Jerome W Donnelly
(74) *Attorney, Agent, or Firm* — Sills, Cummis & Gross P.C.

(57) ABSTRACT

A height adjustable double end training ball apparatus for use in boxing, martial arts and other combat/fighting sports training. The double end training ball having an aperture that extends through the center of the ball and having openings at each end of the aperture on the surface of the ball; a cord having a length suitable to extend from an upper surface to a lower surface, such as a floor and ceiling, in a room where the double end training ball will be used, wherein one end of said cord is connected to the upper surface and the opposite end of the cord is connected to the lower surface; and a pair of restraining elements. The double end training ball is secured on the cord via the application of the restraining elements, such as clamps, at a position above and below the ball.

17 Claims, 3 Drawing Sheets

HEIGHT ADJUSTABLE DOUBLE END TRAINING BAG

FIELD OF THE INVENTION

The present invention relates to exercise equipment and particularly to a training apparatus for use by participants in boxing, martial arts and other combat/fighting sports. More specifically the invention relates to a double end training ball or bag that is suspended on a cord or band that extends from a lower surface to an upper surface to allow the double end training ball to be easily adjusted for use by persons of different heights.

BACKGROUND OF THE INVENTION

Combat sports, also known as a combative sports, are competitive contact sports where two combatants fight against each other using certain rules of engagement (usually significantly different from the rules in simulated combats meant for practice or challenge in martial arts), typically with the aim of simulating parts of real hand to hand combat. Boxing, kickboxing, amateur wrestling, and mixed martial arts are examples of combat sports.

Boxing and mixed martial arts (and all other forms of combat sports) typically require a great deal of training in order to develop and hone the fighting skills. A variety of different training techniques and training devices are utilized in combat sport training.

A boxing or mixed martial arts training program must focus on reactive power, power endurance, muscular endurance, anaerobic endurance and aerobic endurance.

The double end bag, also known as the floor-ceiling bag, crazy bag, or the reflex bag, is a training device comprising an inflated ball suspended between two elastic ropes or cords connected at one end of each part of the ropes to the ceiling and floor in a gym or training room and which is capable of moving around easily, providing the athlete with a valuable piece of equipment for accuracy and timing practice.

Currently used double end training balls are connected on diametrically opposite ends to a piece of cord or rope. The cord or rope is typically elastic. The other ends of the cord or rope are connected to the floor and ceiling respectively in a room, typically a gym or training room. The double end ball is suspended between the cord or rope at a height that permits a boxing or mixed martial arts trainee to punch and jab at the ball. In order to adjust the height of the ball from the floor and ceiling, knots are typically tied at various positions along the cords such that adding and removing knots will lengthen and shorten the cords so as to raise or lower the position of the ball to accommodate users of different heights.

This method of adjusting the ball height is cumbersome and time consuming. A novel double end training ball and an easier and faster method of adjusting the height of a double end training ball is described herein.

The foregoing discussion is presented solely to provide a better understanding of the nature of the problems confronting the art and should not be construed in any way as an admission as to prior art nor should the citation of any reference herein be construed as an admission that such reference constitutes "prior art" to the instant application.

SUMMARY OF THE INVENTION

The present invention provides a height adjustable double end training ball or bag. The terms "ball" and "bag" are used interchangeably throughout this disclosure and are intended to connote the same thing.

In a particular embodiment, the invention provides a double end training ball having an aperture or bore extending through the central diameter of the ball to permit a cord to be passed through such that the ball is slidable on the cord. Restraining elements are attached to the cord above and below the ball or may be integrated within the aperture of the ball, so that the ball is positioned at a desired height along the cord.

Further aspects, features and advantages of the present invention will be better appreciated upon a reading of the detailed description of the invention.

DESCRIPTION OF THE INVENTION

The present invention provides an adjustable double end training ball and methods of using an adjustable double end training ball.

More specifically, the present disclosure provides a double end ball having a bore or aperture extending through the center diameter of the ball to permit a cord to be extended through the bore. The ball is thus slidable along the cord. One end of the cord is connected, attached or fastened to an upper surface, such as the ceiling in a room where use of the double end training ball is desired, and the other end of the cord is connected, attached or fastened to a lower surface, such as the floor. The position or height of the double end training ball on the cord between the floor and ceiling is rendered adjustable using restraining elements or fastener clips/clamps to secure the ball in the desired position on the cord. The restraining elements may be attached to the cord itself or integrated within the aperture in the ball.

Figure 1:
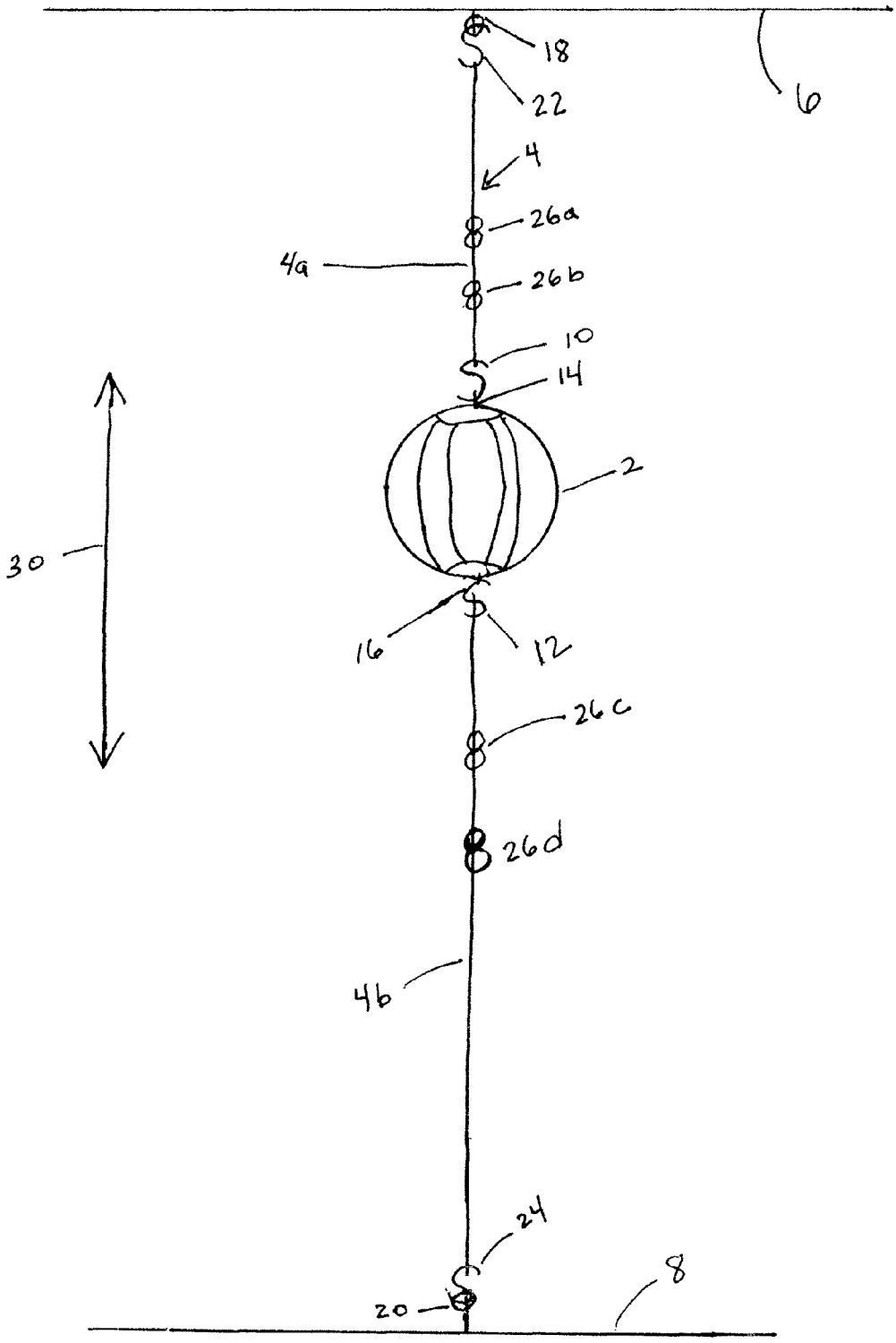
FIG. 1 illustrates one embodiment of a prior art double end training ball.

FIG. 1 illustrates a prior art double end ball that is widely used today in training centers and gymnasiums. As shown in FIG. 1, a double end training ball 2 is retained on a cord 4 that extends between an upper surface 6 and a lower surface 8. In this prior art embodiment, a first cord section 4*a* extends between ball 2 and an upper surface, such as a ceiling 6 and a second cord section 4*b* extends between ball 2 and a lower surface, such as a floor 8. Cords 4*a* and 4*b* typically comprised of 2 separate lengths 4*a*, 4*b*. Upper cord 4*a* extends from the ceiling to the top of ball 2 and lower cord 4*b* is connected to the floor and attaches to the bottom of ball 2. Ball 2 is shown utilizing "S" hooks 10, 12 on the top and bottom of the ball 2 to connect and retain ball 2 with the respective parts of cords 4*a* and 4*b*. In some commercially used double end training balls, the top and bottom side of the ball includes a eyelet 14, 16 through which the "S" hooks, 10, 12 connect cord 4 to ball 2. Additional eyelet screws such as 18, 20 may, in one embodiment, be screwed into the upper surface (e.g., ceiling) 6 and lower surface (e.g., floor) 8 such that "S" hooks 22, 24 at the ends of cords 4*a* and 4*b* respectively, may be connected.

It is noted that the above description of the prior art is not limited to the embodiment described and other methods of connecting cord 4 to the top and bottom of the ball exist. Additionally, several different connection/fastening mechanisms are utilized to connect the opposing ends of the cord to the floor and ceiling respectively.

Athletes training with the double end ball are of different heights and thus need to adjust the height of the ball appropriately to obtain maximum training benefits. Additionally, athletes training with the double end ball may desire to train different types of punches at different times. For example, when an athlete desires to train for punches to the head or upper part of the body, a higher ball height position is necessary. Alternatively when an athlete desires to work on punching to the lower torso area, a lower ball height position is desirable. In prior art double end ball training devices, the height/position of the ball suspended between the upper and lower surface (e.g., floor and ceiling) is adjusted by adding or removing knots (such as those shown as 26*a*-26*d* in FIG. 1) along the length of cords 4*a* and 4*b* and as illustrated by the directional arrow 30.

Tying and untying one or more knots (such as 26*a*-26*d*) on a double end training ball cord can be tedious and time-consuming. The double end training ball of the instant invention eliminates the need for tying and untying knots in the restraining cords and thus facilitates easy and quick positioning of the double end ball on the restraining cords.

Figure 2:
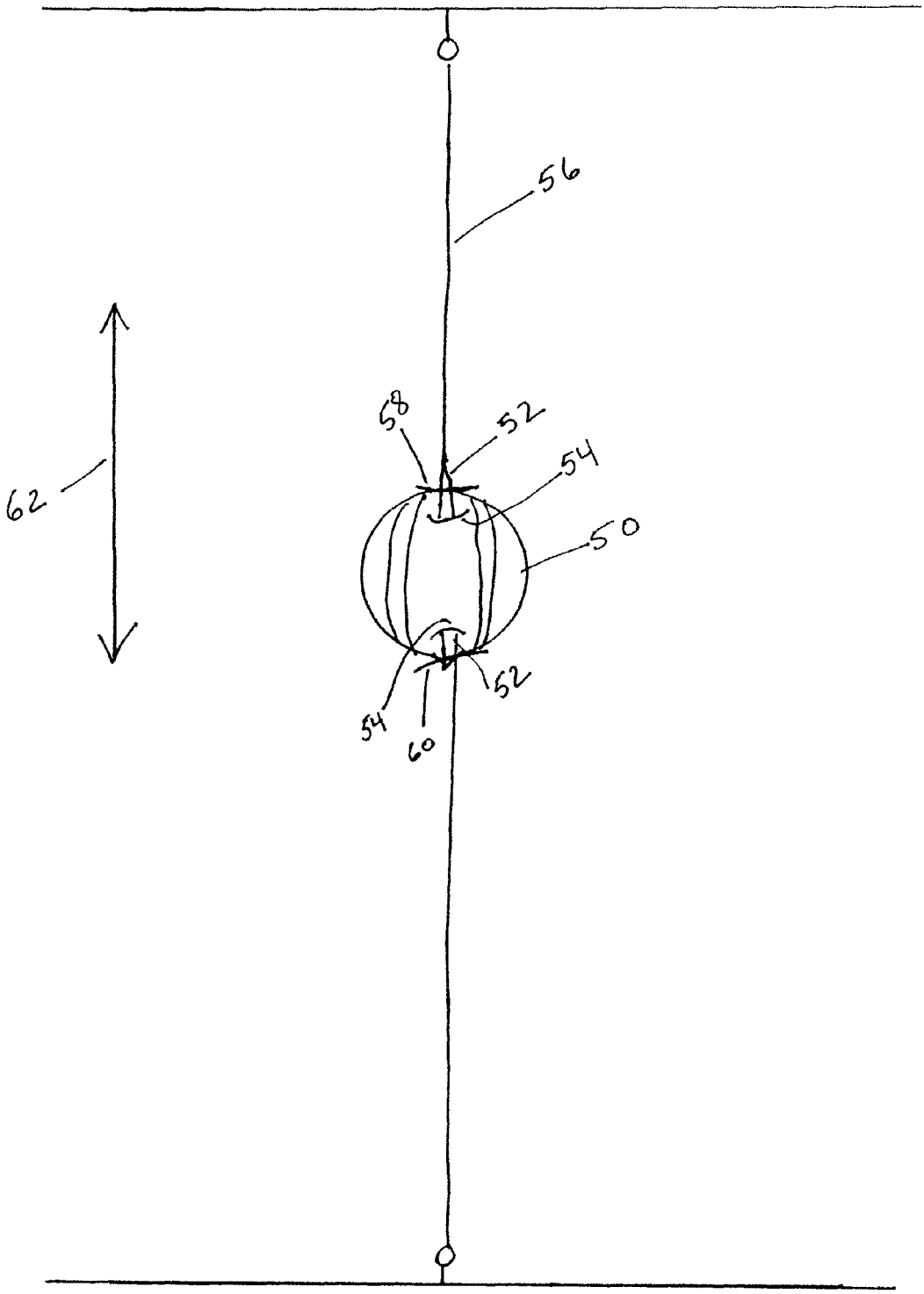
FIG. 2 is a side view of an embodiment of the adjustable double end ball according to the present invention.
Figure 3:
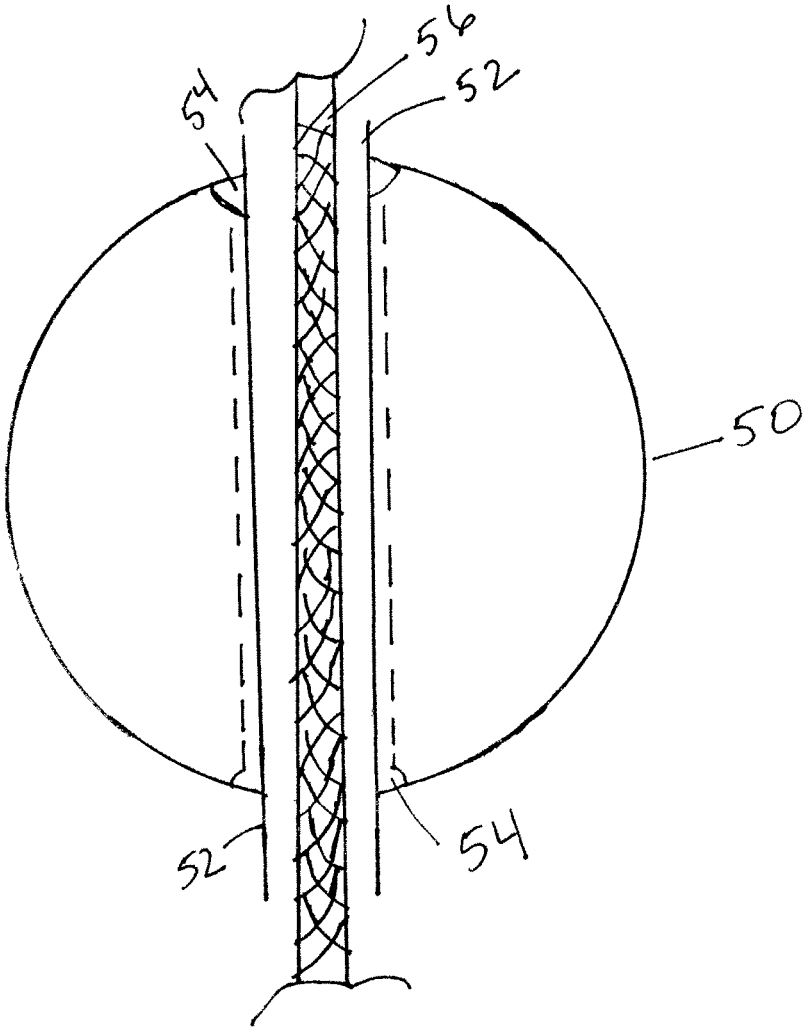
FIG. 3 is a side cut-away view illustrating the interior of a double end ball.

FIG. 2 illustrates a novel double end training ball system in accordance with an embodiment of the instant invention. In FIG. 2, double end training ball 50 comprises a tube 52 that extends through a bore extending through the diameter of ball 50. FIG. 3 provides a cut-away view of ball 50 in which a bore or aperture 54 is shown extending diametrically from the top of ball 50 to the bottom. Tube 52 is inserted through bore 54 and cord 56 is then passed through tube 52. Tube 52 may protrude from the bore openings that are located at the top and bottom of ball 50. In some embodiments, tube 52 is absent and cord 56 is passed directly through bore 54 in ball 50.

Tube 52 may be rubber, plastic, polyvinyl chloride (PVC), fabric or any appropriately flexible material that can extend through the aperture in ball 50. The invention is not limited in any way to the composition of tube 52.

In some embodiments in which ball 50 incorporates a tube 52, the ball 50 is retained in position and/or height on cord 56 by adding a fastener or restraining element 58, 60 to tube 52 that protrudes from ball 50 on the top and bottom of the ball. The addition of restraining elements 58, 60 to tube 52 prevent ball 50 from sliding along cord 56 and allow the easy adjustment and movement of ball 50 on cord 56 along cord 56 as illustrated by directional arrow 62. Restraining elements 58, 60 may be detachable or non-detachable clamps (thus permitting ball 50 to be positioned on cord 56) such as spring clamps although the invention is not limited in this manner and any type of restraining element may be utilized such that the ball 50 is retained on cord 56 between the restraining elements.

In an alternative embodiment, restraining elements 58, 60 are integrated on tube 52. The restraining elements may be hose clamps in which a thin band, typically metallic but not limited thereto, encircles tube 52 and having an attached screw such that when the screw is tightened or loosened, the thin band tightens or loosens around the tube 52 or cord 56. In another embodiment, not shown, hose clamps or another restraining element may be integrated within aperture 54.

The double end training ball 50 is typically an inflated rubber ball that is covered with leather, rawhide, felt or any type of covering contemplated by one or ordinary skill in the art. The invention is not, however, limited in the type of ball covering. A fully rubber ball may also be used.

When properly secured and adjusted, the double end training ball bobs, weaves and gyrates on the cord when struck by a user. The constant movement of the double end training ball facilitates speed, reflex and reaction training.

When utilized in a gym or training room, the invention is not limited in the manner in which the cord is attached or connected to an upper and lower surface (e.g., a floor and ceiling) at those respective ends. For example, "S"-type hooks at the end of the cord may be used to connect the cord end to eyelets protruding from the floor and ceiling. Any other temporary and/or permanent connecting mechanism may be used to attach, connect and/or secure the cord ends to the floor and ceiling.

The double end training ball 50 of the instant invention is not limited to use in a gym or training room nor is the invention limited in such a manner wherein cord 56 is secured between a floor and ceiling, such as illustrated in the prior art embodiment of FIG. 1. While the double end training ball 50 of the instant invention is suitable for installation within a gym or training center, it can also be connected to or secured between arms, such as metal arms, that may be bolted to or removably secured to the floor or ceiling of a room. In an alternative embodiment, the cord of the double end training ball 50 may attach at one end to a tree branch, for example, at its upper end and secured at its lower end to the ground itself or to a securing arm mounted in the ground. In this manner the double end training ball may be utilized outside.

The cord (4 in FIG. 1 and 56 in FIG. 2) is typically and advantageously an elastic and flexible cord or band that permits the ball to bob and weave and return to its starting position when it is hit, struck or kicked by the training athlete. An exemplary type of cord is bungee cord, or elastic shock cord, which is capable of stretching and then returning to its original form. In one embodiment, elastic shock cord comprises numerous tightly packed, synthetic rubber strands that run the entire length of the cord, and which is typically jacketed with a strong, abrasion resistant, braided nylon casing.

It should be understood that the foregoing description is only illustrative of the present invention. Various alternatives and modifications can be devised by those skilled in the art without departing from the invention. Accordingly, the present invention is intended to embrace all such alternatives, modifications and variations that fall within the scope of the appended claims.

What is claimed is:

1. A height adjustable double end training ball comprising:

a. a double end training ball, said double end training ball having an aperture that extends through the center of the ball and having openings at each end of the aperture on the surface of the ball;

b. a cord having a length suitable to extend from a lower surface to an upper surface, wherein one end of said cord is connected to the lower surface and the opposite end of said cord is connected to the upper surface; and c. a pair of restraining elements for attachment on said cord such that said ball is restrained at a desired position on said cord via said restraining elements, wherein said pair of restraining elements are integrated within the ball.

2. The double end training ball according to claim 1 wherein said cord extends through said bore in said double end training ball.

3. The double end training ball according to claim 1 wherein said aperture has a diameter that permits the cord to be passed through said aperture.

4. The double end training ball according to claim 1 wherein said cord is elastic.

5. The double end training ball according to claim 1 wherein one of said pair of restraining elements is positioned on said cord under said double end training ball and the second of said pair of restraining elements is fastened on said cord at a position above double end training ball, wherein said double end training ball is retained on said cord in a position between said pair of restraining elements.

6. A height adjustable double end training ball comprising:

a. a double end training ball, said double end training ball having an aperture that extends through the center of the ball and having openings at each end of the aperture on the surface of the ball;

b. a cord having a length suitable to extend from a lower surface to an upper surface, wherein one end of said cord is connected to the lower surface and the opposite end of said cord is connected to the upper surface; and c. a pair of restraining elements for attachment on said cord such that said ball is restrained at a desired position on said cord via said restraining elements further comprising a tube that extends within said aperture in said double end training ball and through which said cord is passed, wherein said pair of restraining elements is fastened on said tube, wherein further said pair of restraining elements are integrated within said aperture in said ball.

7. The double end training ball according to claim 6 wherein said pair of restraining elements are integrated with said tube on said ball.

8. The double end training ball according to claim 1 wherein said pair or restraining elements is a detachable spring clamp.

9. The double end training ball according to claim 1 wherein said pair of elements comprise a pipe clamp.

10. A method of training for a boxing, martial art or combat sport routine comprising: striking, with the fist or foot, a double end training ball disposed and retained on a cord that extends from lower surface to an upper surface, the double end training ball having an aperture that extends through the center of the ball and having openings at each end of the aperture on the surface of the ball; a cord having a length suitable to extend from a lower surface to an upper surface, wherein one end of said cord is connected to the lower surface and the opposite end of said cord is connected to the upper surface; and a pair of restraining elements for attachment on said cord such that said ball is restrained at a desired position on said cord via said restraining elements, wherein said pair of restraining elements are integrated within the ball.

11. The method according to claim 10, wherein one of said pair of restraining elements is positioned on said cord below said ball and the other of said pair of restraining elements is positioned above said ball to secure said ball between said pair of restraining elements.

12. A method of adjusting the height of a double end training ball comprising positioning a double end training ball on a cord extending from a lower surface to an upper surface, said double end training ball comprising:

a. a double end training ball, said double end training ball having an aperture that extends through the center of the ball and having openings at each end of the aperture on the surface of the ball;

b. a cord having a length suitable to extend from a lower surface to an upper surface, wherein one end of said cord is connected to the lower surface and the opposite end of said cord is connected to the upper surface; and c. a pair of restraining elements for attachment on said cord such that said ball is restrained at a desired position on said cord via said restraining elements, wherein said pair of restraining elements are integrated within the ball.

13. The double end training ball according to claim 12 wherein said aperture has a diameter that permits the cord to be passed through the bore.

14. The double end training ball according to claim 12 wherein said cord is elastic.

15. The double end training ball according to claim 12 further comprising a tube that extends within said aperture in said double end training ball and through which said cord is passed.

16. The double end training ball according to claim 12 wherein said pair or restraining elements is a detachable spring clamp.

17. The double end training ball according to claim 12 wherein said pair of elements comprise a pipe clamp.

* * * * *